US008365483B2

(12) United States Patent
Hijazi

(10) Patent No.: US 8,365,483 B2
(45) Date of Patent: Feb. 5, 2013

(54) PREFABRICATED BUILDING SYSTEM

(76) Inventor: Yousef Hijazi, Jeddah (SA)

( * ) Notice: Subject to any disclaimer, the term of this patent is extended or adjusted under 35 U.S.C. 154(b) by 513 days.

(21) Appl. No.: 12/586,245

(22) Filed: Sep. 18, 2009

(65) Prior Publication Data

US 2011/0067321 A1 Mar. 24, 2011

(51) Int. Cl.

| | |
|---|---|
| ***E04H 1/00*** | (2006.01) |
| ***E04B 1/32*** | (2006.01) |
| ***E04B 5/04*** | (2006.01) |
| ***E04C 3/30*** | (2006.01) |

(52) U.S. Cl. ..... 52/245; 52/604; 52/575; 52/79.1

(58) Field of Classification Search ..... 52/79.1, 52/79.3, 79.4, 80.1, 81.1, 86, 88, 89, 236.2, 52/245, 247, 249, 284, 503, 504, 575, 604, 52/605, 608, 745.07, 745.08

See application file for complete search history.

(56) References Cited

U.S. PATENT DOCUMENTS

| | | | | | |
|---|---|---|---|---|---|
| 106,203 | A * | 8/1870 | Quinby | 52/245 |
| 884,498 | A * | 4/1908 | King | 52/89 |
| 1,299,884 | A * | 4/1919 | Webber | 52/249 |
| 1,452,583 | A * | 4/1923 | Williams | 52/575 |
| 1,784,271 | A * | 12/1930 | Collins | 405/124 |
| 3,093,847 | A * | 6/1963 | Strecker | 114/357 |
| 3,171,370 | A * | 3/1965 | Fay | 110/335 |
| 4,505,088 | A * | 3/1985 | Lippe | 52/745.07 |
| 4,653,238 | A * | 3/1987 | Berman | 52/79.4 |
| 4,765,103 | A * | 8/1988 | Clarke | 52/86 |
| 5,069,015 | A * | 12/1991 | Steinwender | 52/575 |
| 5,916,097 | A * | 6/1999 | Markuten | 52/81.2 |
| 5,934,027 | A * | 8/1999 | Khalili | 52/167.1 |
| 6,931,797 | B2 * | 8/2005 | Drew | 52/86 |
| 2004/0118056 | A1 * | 6/2004 | Peters et al. | 52/79.1 |
| 2006/0207193 | A1 * | 9/2006 | Lilke | 52/79.7 |
| 2007/0094944 | A1 * | 5/2007 | James | 52/79.1 |
| 2009/0031621 | A1 * | 2/2009 | Kitagawa | 47/17 |

* cited by examiner

*Primary Examiner* — Joshua J Michener
*Assistant Examiner* — Ryan Kwiecinski
(74) *Attorney, Agent, or Firm* — Knechtel, Demeur & Samlan

(57) ABSTRACT

A prefabricated building that is easily assembled from plastic components or elements. These elements are formed in a shape that has special joining configurations to allow the elements to longitudinally slide into respective receiving grooves on an adjacent element to form the building structure. The elements have a surface inclination so that when they are joined to adjacent elements they give the building a cylindrical outer shape. Other elements are joined together in a similar fashion to form vertical walls to form the front and back of the building and dividing walls.

16 Claims, 21 Drawing Sheets

PREFABRICATED BUILDING SYSTEM

FIELD OF THE INVENTION

This invention is related to prefabricated buildings and more particularly to a building that is easily assembled from plastic components or elements. The plastic building components are joined together by a tongue and groove joining system that allows for quick assembly by unskilled laborers.

BACKGROUND OF THE INVENTION

The majority of conventional prefabricated buildings (one floor or more) are constructed by assembling the building structure components which are made out of steel, wood, or any other structural material. The components for the floors, walls, and ceilings are similarly made out of wood, gypsum boards, fibreglass panels, zinc or steel sheets and are attached in conventional manner. Finishing of the walls or ceilings is usually done by painting or ceramic cladding. The floors are finished by wood or any type of floor tiling. The facade can be aluminium siding or glass reinforced concrete ("GRC") sheets. Doors and windows as well as electro-mechanical installations are pre-assembled and wired for installation. Generally all construction, assembly, installation, and finishing operations are done either in the production line or at the construction site by the factory trained laborers.

There are several problems with the available technologies. First, they require skilled laborers. These people must be trained in the particular techniques and skills required to assemble the structure. Each manufacturer has its own specific product and methodology to assemble the structure. Second, most technologies require a skeleton structural system before creating enclosures. Thus, a skeleton structure such as walls, floors and ceilings which supports the balance of the structure must first be constructed. Third, most available technologies require different interior and exterior finishing tasks that waste time, energy and money. Fourth, unless shipped in their bulky sizes on large trucks, most available prefabricated systems require elaborate efforts for dismantling the structure by skilled laborers with the risk of damaging some of its components. Fifth, most available prefabricated systems require finishing and assembly activities at the job site by skilled laborers that raise the cost.

Applicant's invention is a prefabricated plastic house designed for self-assembly. This helps the user save money by assembling it himself with the limited help of another person. This can be accomplished in about one day's time due to all prefixed preinstalled components in one package. Other advantages of applicant's invention is the design provides a residential unit that does not need any type of architectural finishing, water or heat proofing, plastering, painting or ceramic cladding of the bathroom or kitchen walls.

Another advantage is the prefabricated plastic house does not need any type of skilled laborers for assembly or installation of cylindrical building plastic components, doors and windows, electrical wiring, fixtures, pipes and wall plumbing fixtures. The installation and assembly of floor plumbing and sanitary fixture installation is also minimized.

A further advantage is the inventive prefabricated plastic house allows the possibility of dismantling and re-assembly of the house at a new site. The invention allows the structure to be quickly shipped to disaster areas to provide quick relief to people in need by providing rapid housing solutions with a quality living structure which is environmentally friendly.

SUMMARY OF THE INVENTION

Applicant's invention solves the problems of the prior art by providing a plastic structure designed for self-assembly.

The structural system of the cylinder is simple and easy to construct. The structure is formed from inexpensive hollow plastic elements preferably made from polyvinyl chloride ("PVC"). In a side view it appears as a horizontal structure. In the front or rear view it has a vertical cross section of approximately three quarters of a four meter in diameter circle. The clear height at the middle area along the center line is about three meters.

The outer shell of the cylinder consists of fifty-six hollow PVC shell elements, twenty-eight on each side. These shell elements are extruded during manufacturing to form their unique shape with special joining configurations to allow the shell elements to longitudinally slide into respective receiving grooves on an adjacent shell element and integrate together to form the structure. The shell elements have a certain surface inclination so that when they are joined to adjacent shell elements they give the cylindrical shape its own curvature.

The base of the cylindrical shell rests on two longitudinal reinforced concrete grade beams contained in two longitudinal hollow PVC base elements. These base elements are extruded in their unique shape with a configuration that allows the first row of the shell elements to longitudinally slide and integrate with the base elements.

The exterior front and back walls and interior partitions of the cylindrical unit consist of several rows of longitudinal hollow PVC flat wall elements extruded in their unique shape with a configuration that allows the flat wall elements to longitudinally slide and integrate with adjacent flat wall elements.

The exterior front and back walls and interior partition profiles are profiled in their length to form a curved edge that can align with the curved shell. The length of the plastic house can vary depending on the number of modules connected together to create a residential unit.

DESCRIPTION OF THE PREFERRED EMBODIMENT

Figure 1:
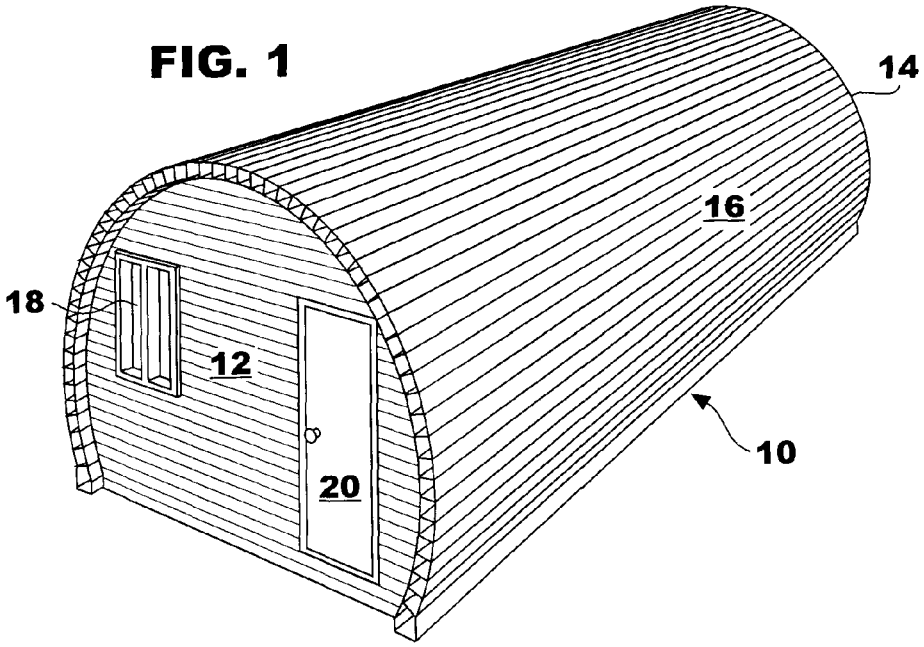
FIG. 1 is a perspective view of a building constructed from the present inventive building system.
Figure 3:
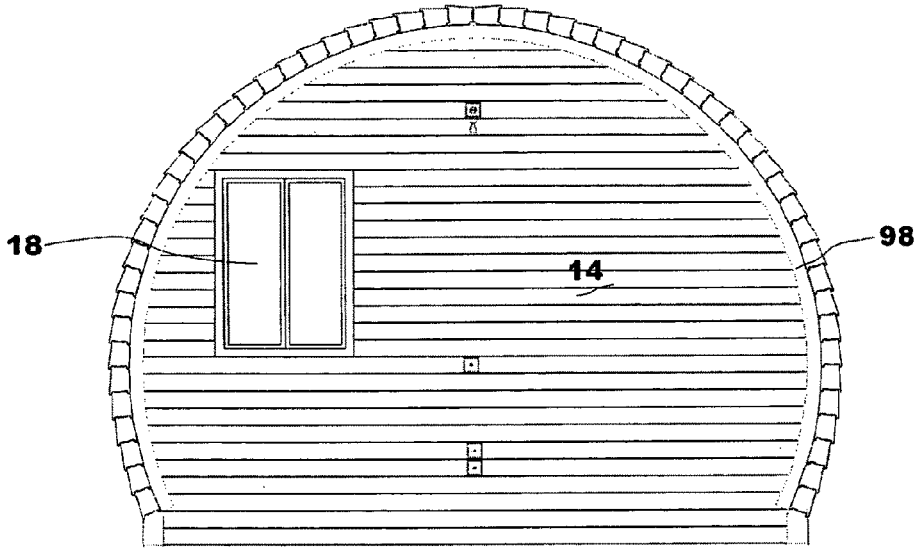
FIG. 3 is a rear exterior elevation view of a building constructed according to the present invention.
Figure 4:
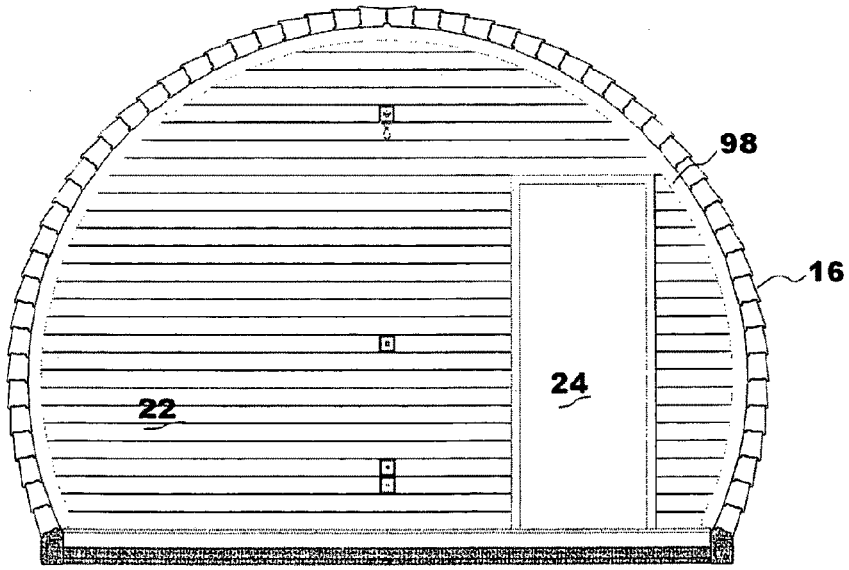
FIG. 4 is a cross sectional view taken across line 2-2 of FIG. 1 of the inventive building system.

Turning first to FIG. 1, there is illustrated a perspective view of a prefabricated building or structure 10 of the present invention. The building 10 has a front 12, a rear 14 and an exterior wall or shell 16. The front 12 is more clearly illustrated in FIG. 2 and the rear 14 is more clearly illustrated in FIG. 3. The front 12 has a window 18 and door 20. Other openings and structures can be designed into the front 12. The rear also has a window 18 and may have other windows or doors. FIG. 4 illustrates an interior view looking toward the rear of the building 10. There is an interior vertical wall 22 that divides the interior of the building into separate rooms and a doorway 24 that provides access between adjacent rooms.

Figure 5:
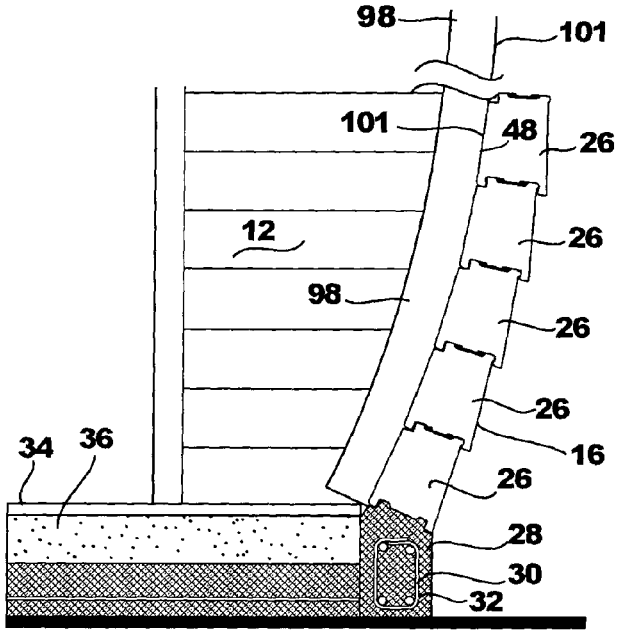
FIG. 5 is a cross sectional view with portions removed of the side elements joined to the base element which is anchored in concrete.

FIG. 5 is an enlarged view showing one corner of the building 10. There are individual exterior or shell elements 26 that, when joined together, form the exterior shell 16. The bottom most shell element 26 is joined to a base element 28 that is preferably plastic and initially hollow. The base element 28 is filled with concrete or other suitable building material 30 and is further reinforced with steel forms or rebar 32. The base element 28 rests on grade. The building 10 has a floor 34 that can be of typical flooring materials such as tile, wood which rests on sand and mortar 36, which in turn can be on grade or additional concrete 30.

The exterior wall or shell 16 with its base element 28 represents 67.5% of the circumference of a circle having a four meter diameter. In the preferred embodiment, one side of the exterior shell 16 consists of twenty-eight plastic hollow exterior or shell elements 26 joined to and supported by the base element 28. There is a mirror image of twenty eight plastic hollow exterior or shell elements 26 joined to and supported by another base element on the other side.

The opposite sides of the exterior wall or shell formed from exterior elements 26 meet at the summit of the building 10 where an end element 38 meets an opposite end element 40. End elements 38 and 40 are identical to the other exterior or shell elements 26. The end elements 38 and 40 are joined together by a special profile 42 that slides in receiving channels 44 in top surfaces 46 of the exterior elements 26.

Figure 7:
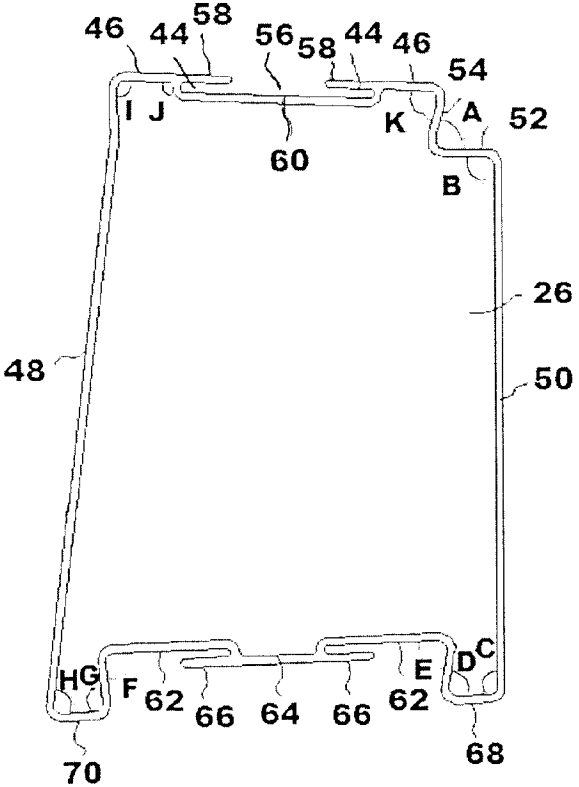
FIG. 7 is cross sectional view of a shell element.

The typical shell element 26 is more clearly illustrated in FIG. 7. The shell element 26 is approximately a 119.4×167.7 mm rectangle with non parallel sides 48 and 50 with other inclinations that allow shell element 26 to integrate with adjacently stacked shell elements 26 in a curved line. Side 48 is intended to be the outer or exterior face of the shell element and side 50 is intended to be the inner or interior face of the shell element 26. The overlapping of the shell elements 26 is more clearly illustrated in FIG. 5. This overlapping will not only prevent rain water from flowing inside the building 10 but also helps it to drain to the outside achieving means for water resistance. The wall thickness of the shell element 26 is about two mm. This thickness is subject to change according to structural requirements which vary according to materials and different spans. The shell element 26 has a length that depends on the modular size required for different proposed functions.

As can be seen in FIG. 7, the shell 26 has the top surface 46 dropping down to a shoulder 52 on one side of the shell 26. An upstanding wall 54, which is at an acute angle A of about 78°, connects the shoulder 52 to the top surface 46. It can be seen that the top surface 46 has a gap or opening 56 formed by outstanding arms 58. Below the opening 56 is a shelf 60 that forms the bottom of the receiving channel 44.

The shell element 26 also has bottom surface 62. Extending down from the bottom surface 62, and approximately at the midpoint of the bottom surface, is a male member 64 with opposite extending tongues 66. There is a pair of opposed feet 68, 70 at the bottom of the shell 26.

The angles at which the various exterior walls of the shell element 26 form with respect to adjoining walls are important. The angles help define and create the cylindrical shape of the exterior of the building 10. Moving clockwise from angle A, which was approximately 78°, we see that the other angles are as approximately as follows: angle B is 92°, angle C is 92°, angle D is 78°, angle E is 79°, angle F is 85°, angle G is 85°, angle H is 82°, angle I is 85°, angle J is 90°, and angle K is 79°.

Figure 2:
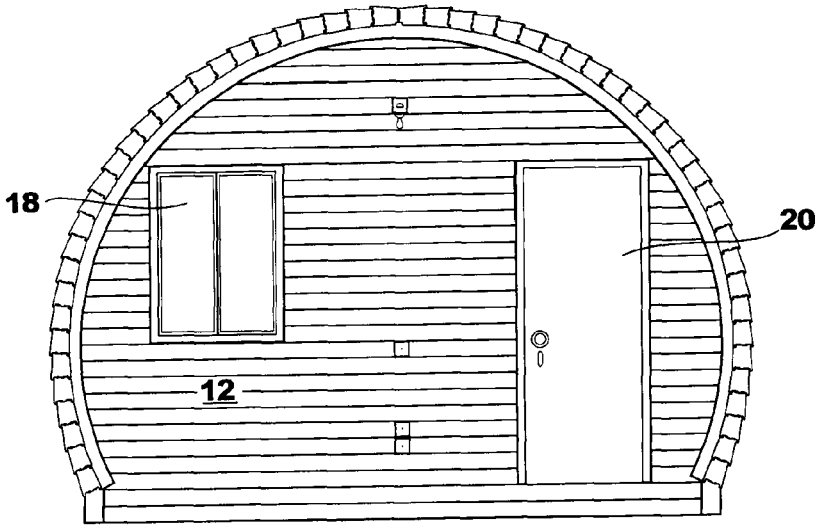
FIG. 2 is a front exterior elevation view of a building constructed according to the present invention.

The top surface 46 is at an acute angle with respect to the bottom surface 62, which is in substantially a horizontal plane. This causes the shell elements 26 to form a curvilinear outer surface such as illustrated in FIG. 2 when the shell elements are assembled to form the building 10.

Figure 8:
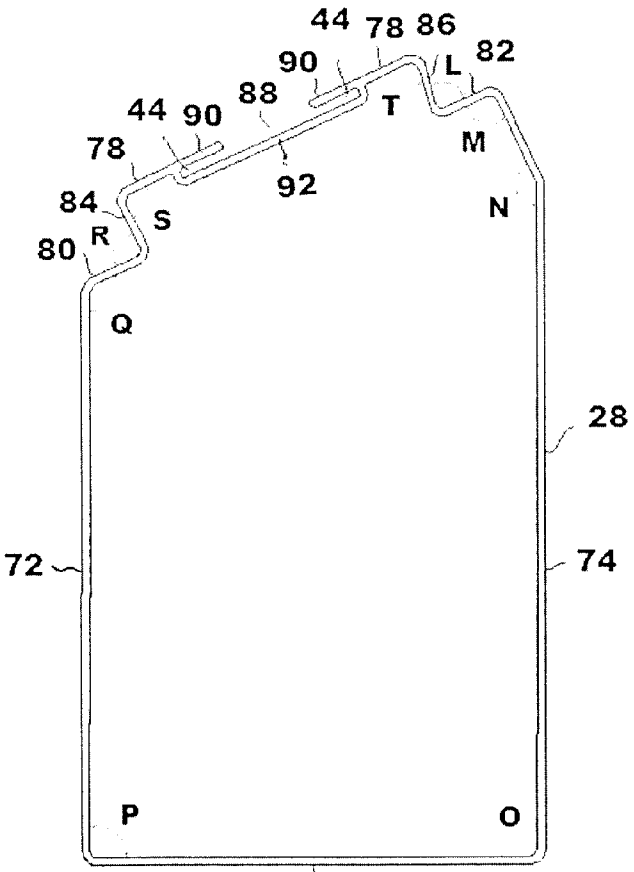
FIG. 8 is a cross sectional view of the base element.
Figure 9A:
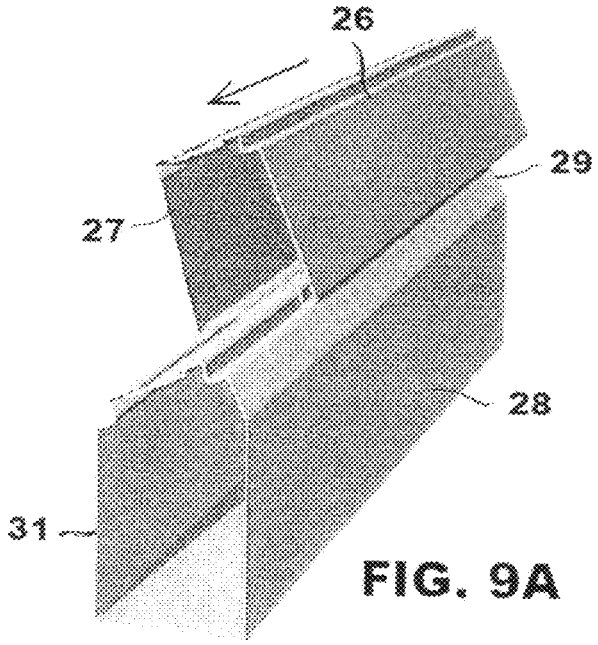
FIG. 9A is a perspective view of a shell element being slid onto an adjacent base element.
Figure 9B:
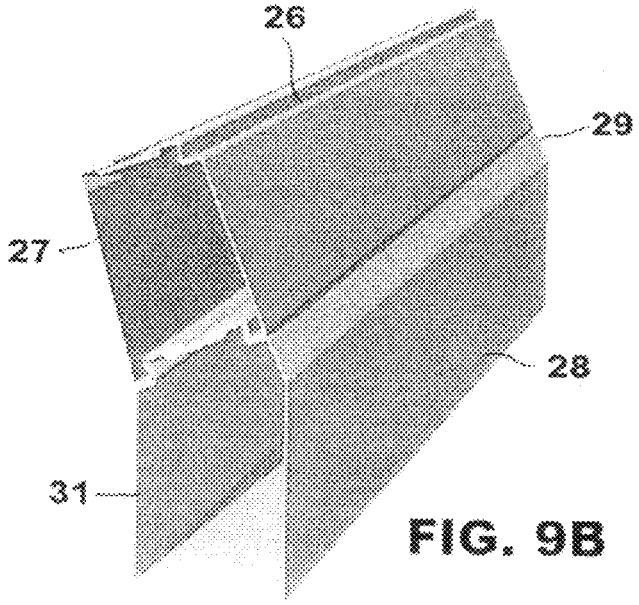
FIG. 9B is a perspective view of the shell element of FIG. 9A in the fully joined position.

As seen in FIG. 8, the base element 28 is comprised of an exterior upstanding wall 72 and interior upstanding wall 74. These walls are substantially parallel to each other. They are joined at the bottom by a base wall 76. There is a top surface 78 that drops down to opposite shoulders 80, 82 on both sides of the base element 28. Upstanding walls 84, 86 connect the shoulders 80, 82 to the top surface 78. Similar to the shell element 26, the top surface 78 has a gap or opening 88 formed by outstanding arms 90. Below the opening 88 is a shelf 92 that forms the bottom of the receiving channel 44. The typical base element 28 is illustrated in FIG. 8 and an alternative embodiment of a modified base element is seen in FIGS. 9A and 9B. In the alternative embodiment, the base element has a hexagon cross section shape with outside dimensions of approximately 120×209 mm. This base element 28 is joined to the shell element 26 to form the bottom of the shell 16. The base element 28 has a wall thickness of about two mm. The size of the base element 28 and its wall thickness are subject to change according to any structural requirements and different module sizes. The length of base element 28 coincides with the length of shell element 26 and depends on the modular size required for the length of the building 10.

The angles that the walls of the base element 28 form with respect to adjoining walls are important to support the shell elements 26 and to help create the cylindrical shape of the building 10. Moving clockwise around the perimeter of the base element 28, the angles are approximately as follows: Angle L is 79°, angle M is 90°, angle N is 155°, angle O is 90°, angle P is 90°, angle Q is 114°, angle R is 85°, angle S is 85°, and angle T is 79°. In order to build the exterior wall or shell 16, the individual shell elements 26 are joined one on top of the other and supported by a base element 28 as described herein.

Figure 23A:
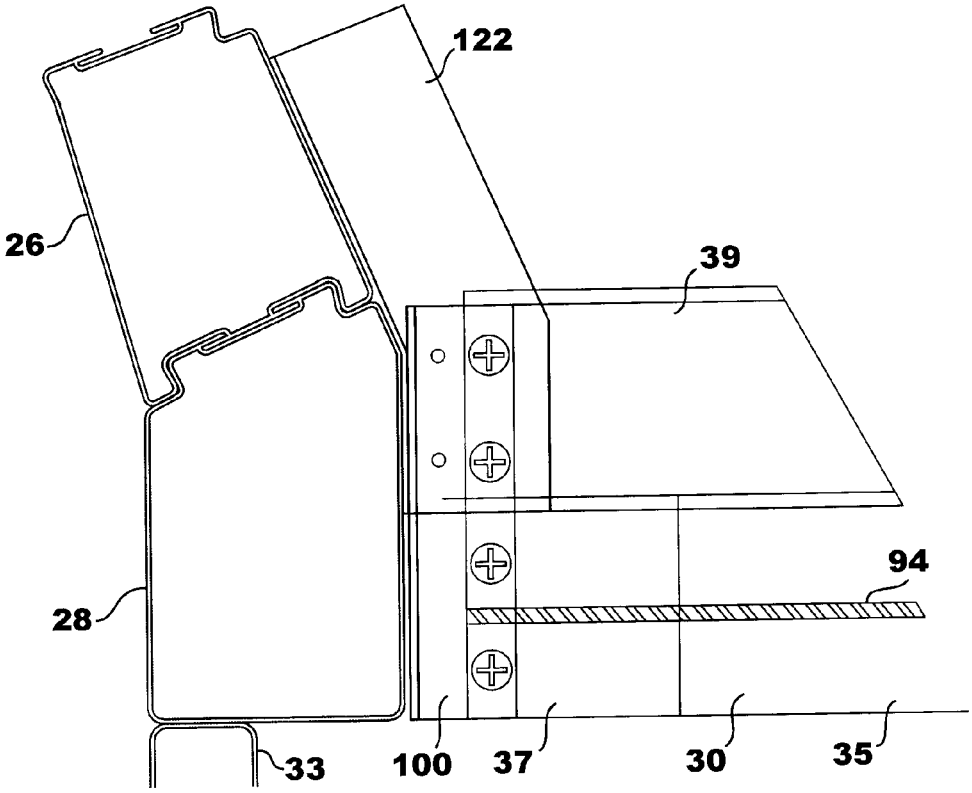
FIG. 23A is a front elevation view with portions removed of the base element connected to the U-shaped base member which is mounted on a concrete base.
Figure 23B:
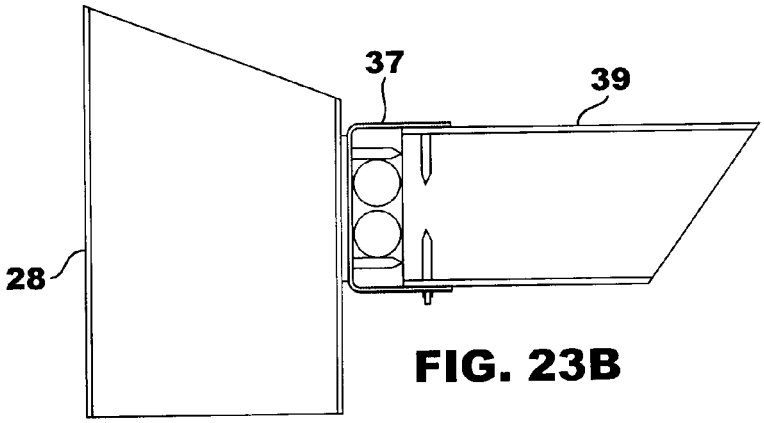
FIG. 23B is top plan view of the base element connected to the U-shaped base member.

In order to build the building 10, it is necessary to first prepare the base as illustrated in generally in FIG. 5 and in greater detail in FIGS. 23A and 23B. Once the size of the building is determined, which is preferably based on the prefabricated dimensions of the base elements 28 and the shell elements 26, the base element 28 is set on grade. A site leveling steel frame 33 is used to level the base element 28. The base element 28 will either already have the rebar 32 and concrete 30 poured into the hollow interior of the base element 28 or this can be done at the place of erection of the building 10. Depending on the side of the building being assembled, the base element 28 will appear as in FIG. 5 or FIG. 9. However, the construction of either side of the building 10 is identical. A sub base element 37, which acts as a spacer element, is slid under the grade beam 39. A concrete pad 35 is poured and the concrete is allowed to freely flow to fill the space inside and around the sub base element 37. There is a second reinforcement bar 32' that is welded to a frame wall 100 and is within the sub base element 37. When the concrete pad 35 is poured the reinforcement bar 32' is encapsulated within the concrete pad 35.

With the base element 28 in place, the bottommost shell element 26 is positioned so that one end 27 of the shell element 26 is adjacent to one end 29 of the base element 28. The male member 64 is aligned with the gap 88 so that the tongues 66 will be received in the receiving channels 44. In a similar fashion, the foot 68 is dimensioned so that it is received in non binding engagement by the shoulder 82 and upstanding wall 86. The other foot 70 is dimensioned so that it is received in non binding engagement by the shoulder 80 and upstanding wall 84. With the shell element 26 in parallel alignment with the base element 28, the shell element is slid onto the base element 28 as seen in FIG. 9A until the end 27 of the shell element is flush with an opposite end 31 of the base element as seen in FIG. 9B.

Figure 6:
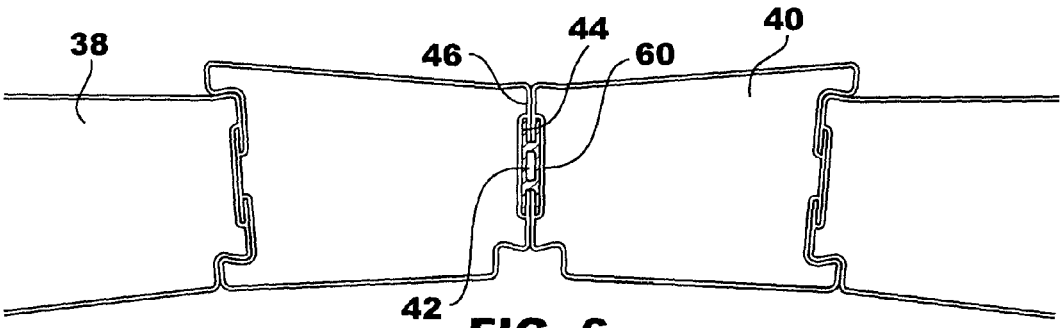
FIG. 6 is a cross sectional view with portions removed of the joining element at the top of the building that joins the opposite two curved exterior walls of the shell.
Figure 6A:
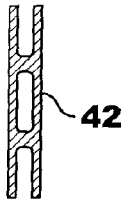
FIG. 6A is a cross sectional view of the joining element.
Figure 10A:
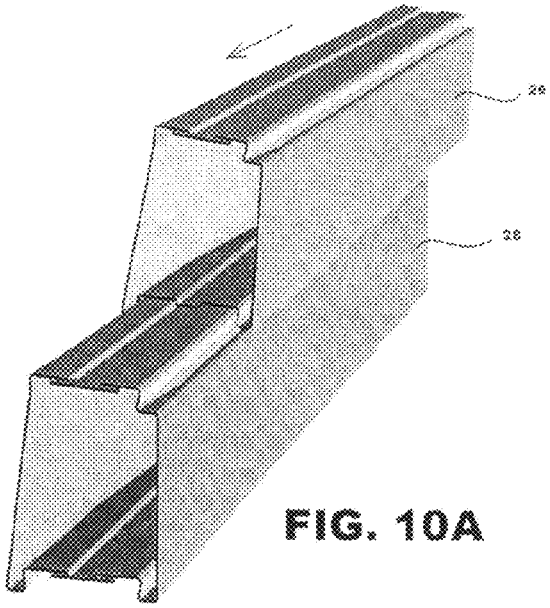
FIG. 10A and FIG. 10B are perspective views of one shell element being slid onto an adjacent shell element into the fully assembled and joined position.
Figure 10B:
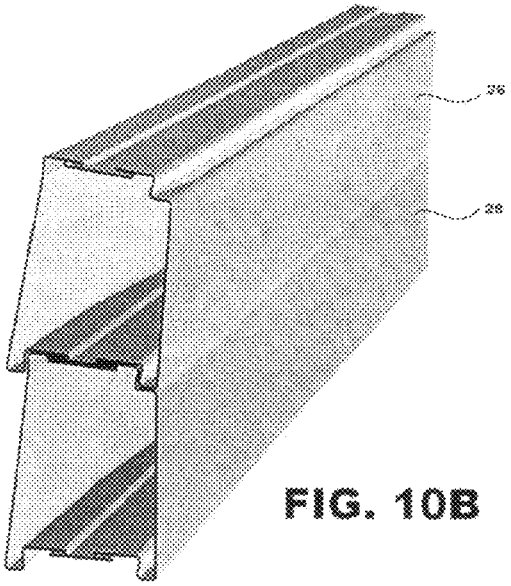

This assembly procedure is continued with the male member 64 of the next higher shell element 26 being received by the gap or opening 56 in a lower shell element 26. The tongues 66 are received in the receiving channels 44 and the shell element 66 is slid onto the lower shell element 66. This connecting process is repeated as illustrated in FIG. 10A and FIG. 10B. The opposite side of the building 10 is similarly constructed until the two opposed outer walls or shells 16 meet at the top. This is clearly illustrated in FIG. 6. The two top surfaces 46 of confronting end elements 38, 40 abut each other. The profile 42 is inserted into the receiving channels 44 of the end elements 38, 40. This completes assembly of the exterior shell 16.

Figure 11:
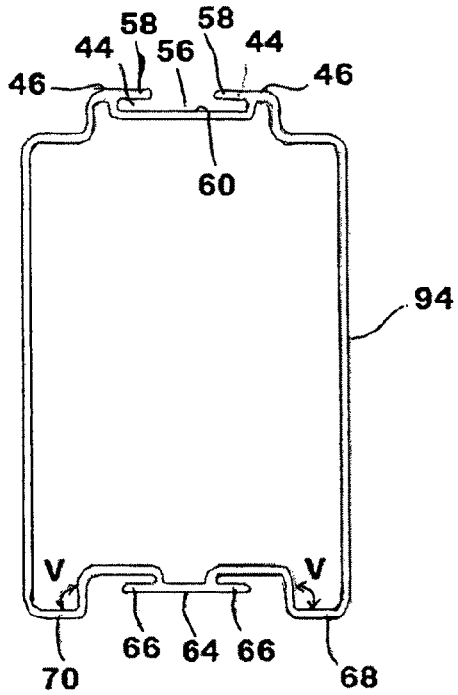
FIG. 11 is across sectional view of a wall element.
Figure 12A:
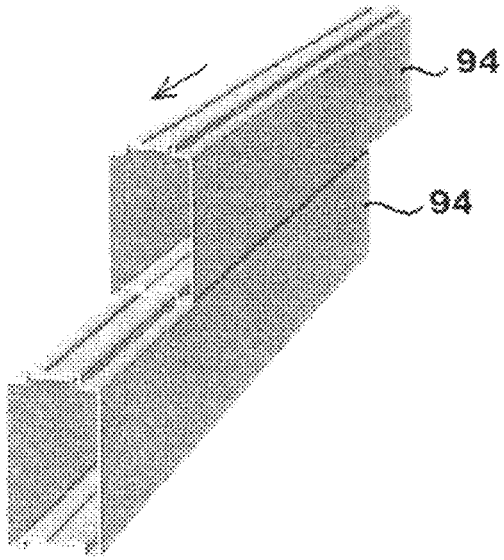
FIG. 12A and FIG. 12B are perspective views of one wall element being slid onto an adjacent wall element into the fully assembled and joined position.
Figure 12B:
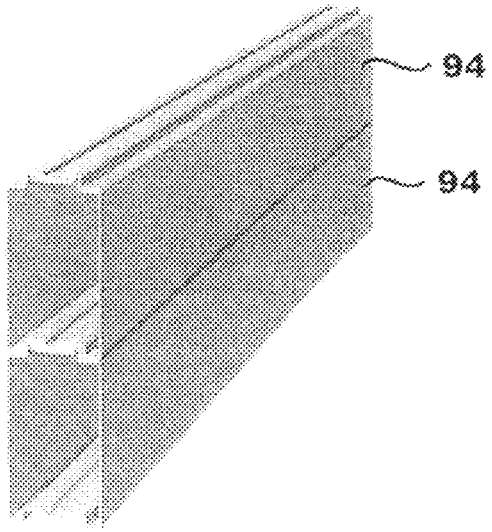

The front 12, rear 14 and interior vertical walls 22 are assembled in a similar manner. FIG. 11 illustrates a wall element 94. It is seen that many of the same components that comprise the shell element 26 are found in the wall element. For example there is the top surface 46 with the gap or opening 56. Receiving channels 44 are formed by arms 58 and the shelf 60. There are feet 68, 70 on opposite sides at the bottom of the wall element 94. There is a male member 64 with outstanding tongues 66 at the bottom of the wall element 94. However, opposed sides 96 are parallel to each other. Angles U and V are both 85°. The wall 22 is assembled by sliding the wall elements into each other as illustrated in FIGS. 12A and 12B.

Figure 13:
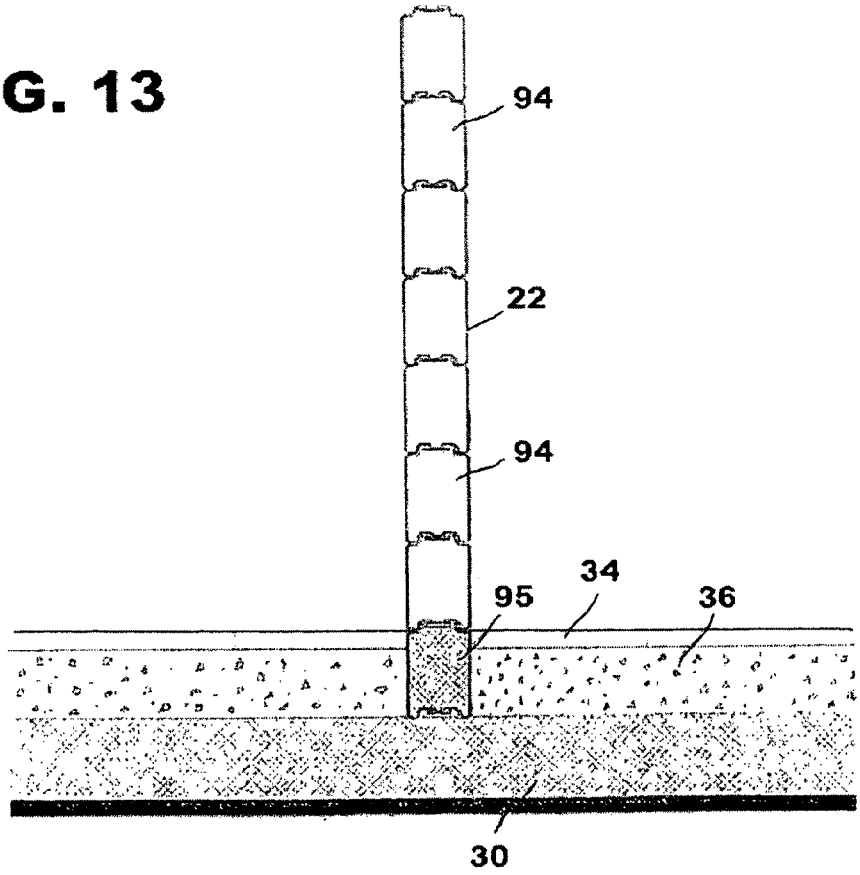
FIG. 13 is a cross sectional view with portions removed of the wall elements stacked on top of each other to form a wall.

As seen in FIG. 13, the partially constructed interior vertical wall 22 has a bottom wall element 95 which is anchored in the sand and mortar 36. The feet 68, 70 rest on and are supported by the concrete 30. The floor 34 abuts the bottom wall element 95.

To create a seal to minimize air flow around the front 12, rear 14, and interior vertical walls 22 and the exterior wall or shell 16, the front, rear and interior walls are framed with U-shaped curved aluminum frames 98 (FIGS. 4 and 5). These align with the curved or rounded shape of the exterior shell 16. FIGS. 16A-16D illustrate the U-shaped curved aluminum frame 98. The U-shaped frame 98 has frame walls 100 with a bottom 101 defining the bottom of the "U" and on opening 102 opposite the bottom 101. A width "w" of the opening 102 is dimensioned to closely receive the end of the wall element 94 as it is slid into the U-shaped frame 98. The bottom 101 of the curved frame 98 abuts the non parallel side 48 of the shell element 26. In this manner the U-shaped curved frame 98 provides a smooth transitional interface between the ends of the front 12, rear 14 or vertical wall 22 and the exterior wall or shell 16.

Figure 14A:
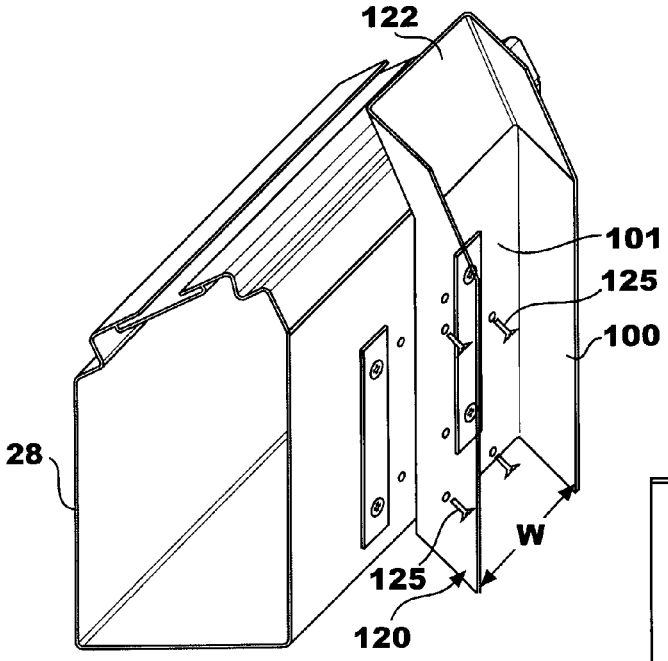
FIG. 14A is a perspective view with portions removed of a base element joined to a U-shaped base member.
Figure 14B:
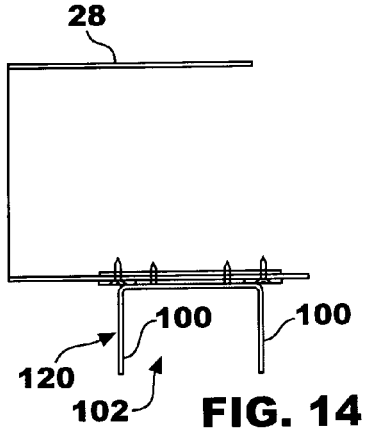
FIG. 14B is a top view with portions removed of FIG. 14A of the base element joined to the U-shaped base member.
Figure 14C:
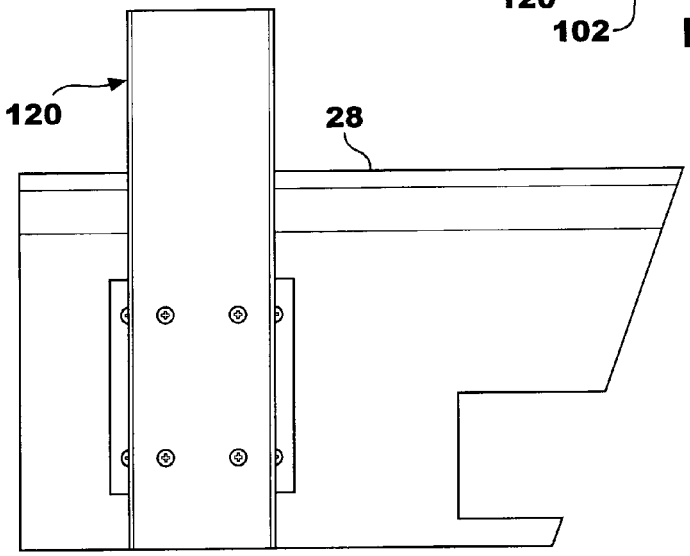
FIG. 14C is a side view of FIG. 14A showing the base element joined to the U-shaped base member.
Figure 15A:
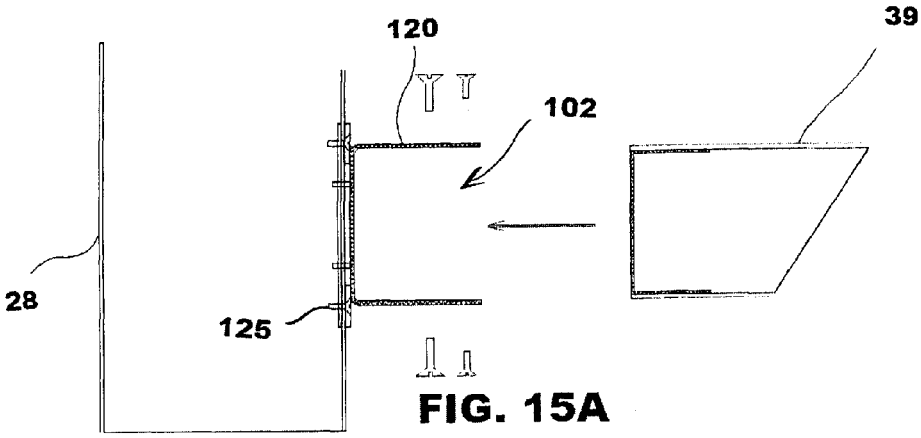
FIG. 15A is a top plan view with portions removed of a bottom wall element ready to be attached to a base element by means of a U-shaped base member.
Figure 15B:
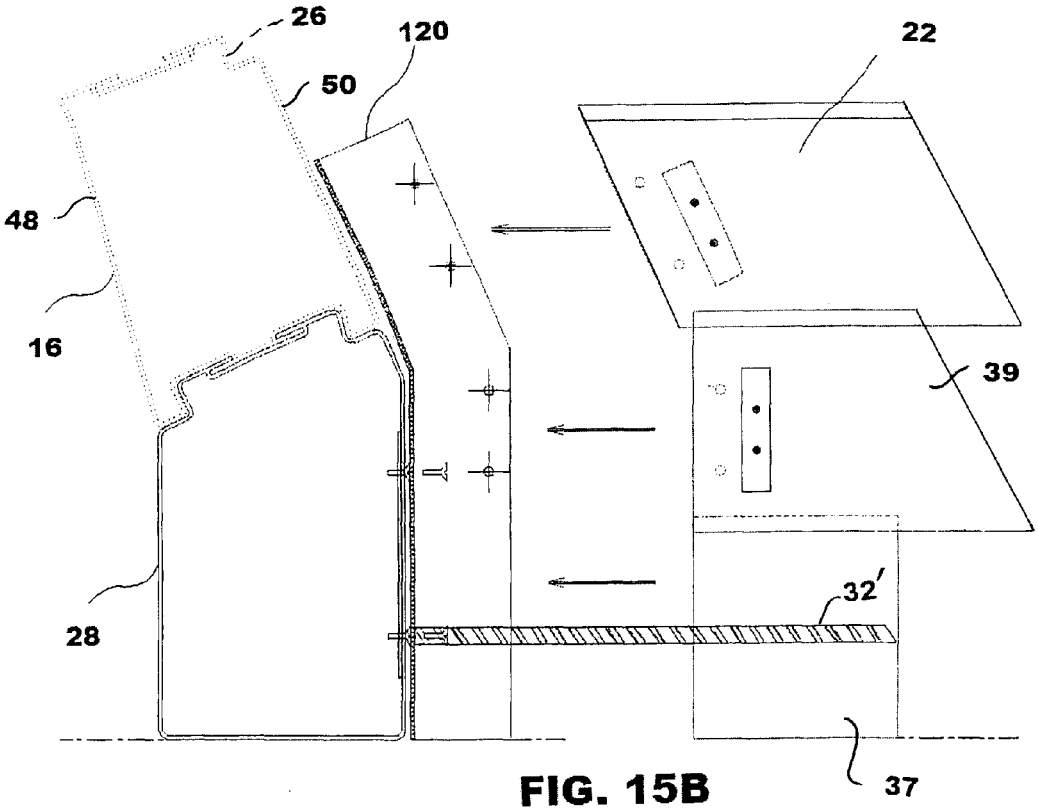
FIG. 15B is a front view of the of the bottom wall element ready to be attached to the base element by means of the U-shaped base member.

As seen in FIGS. 14A-14C a U-shaped base member 120 is attached to the base element 28. The base member 120 has many of the same elements as the U-shaped curved frame 98 such as frame walls 100, a bottom 101, and a frame opening 102. However, this U-shaped member 120 also has a U-shaped angled top portion 122 that is angled to follow the slope of the shell element 26 of the bottom of the exterior wall 16 as seen in FIG. 15B. Once the U-shaped base member 120 is attached to the base member 28, it can be secured to the sub base element 37 below the grade beam 39 and filled with concrete 30. The U-shaped angled top portion 122 receives the U-shaped curved frame 98.

Figure 14D:
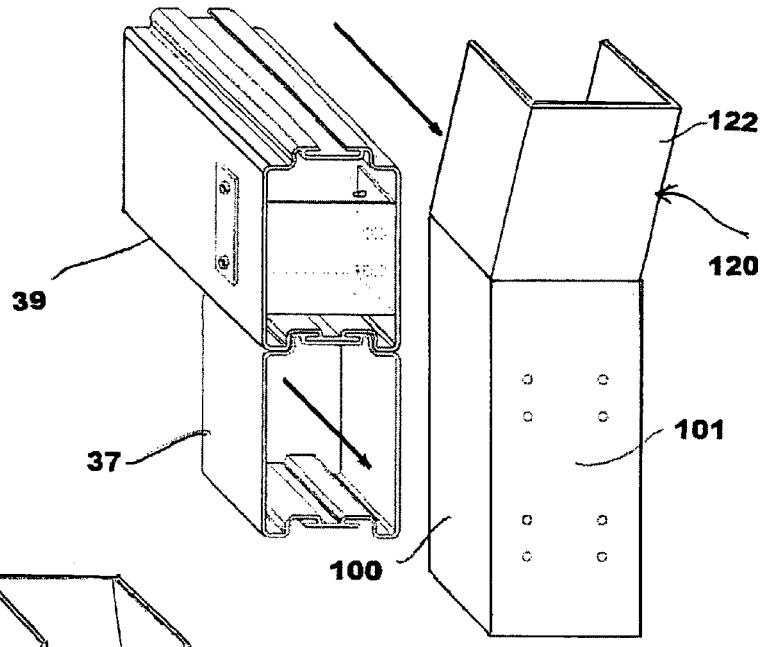
FIG. 14D is a perspective view with portions removed of a wall element in position to be joined to a U-shaped base member.
Figure 14E:
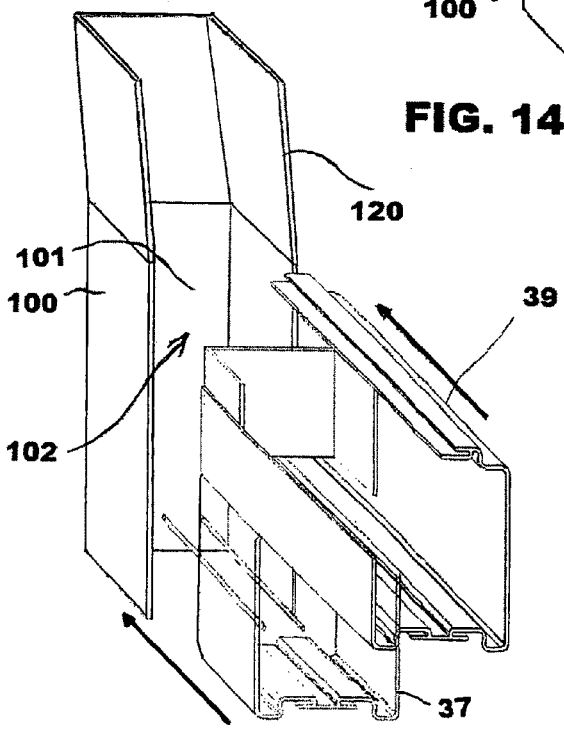
FIG. 14E is a perspective view of the opposite view of FIG. 14D with portions of the wall element removed for clarity.
Figure 14F:
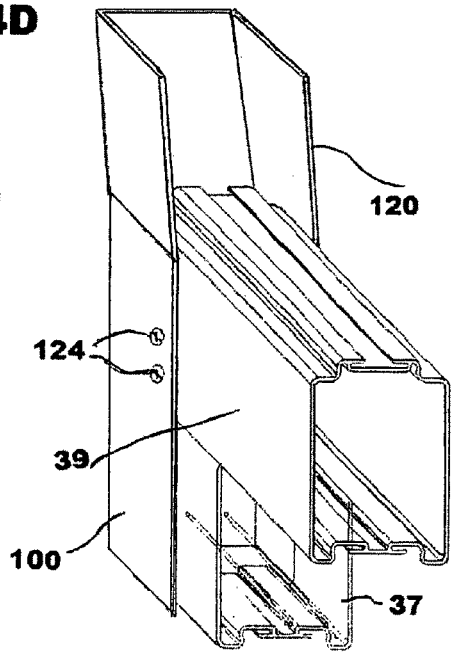
FIG. 14F is a perspective view of the wall element joined to the base element, with portions of the wall element removed for clarity.

FIGS. 14D-14F illustrate the attachment of the front 22 or wall elements 94 to the U-shaped base member 120. As illustrated, the lowermost wall element is identified as grade beam 39 upon which the wall elements 94 are mounted. The assembled and stacked wall elements 94 are received into the frame opening 102 and securely fastened by fasteners 124 passing through the frame walls 100.

Figure 15C:
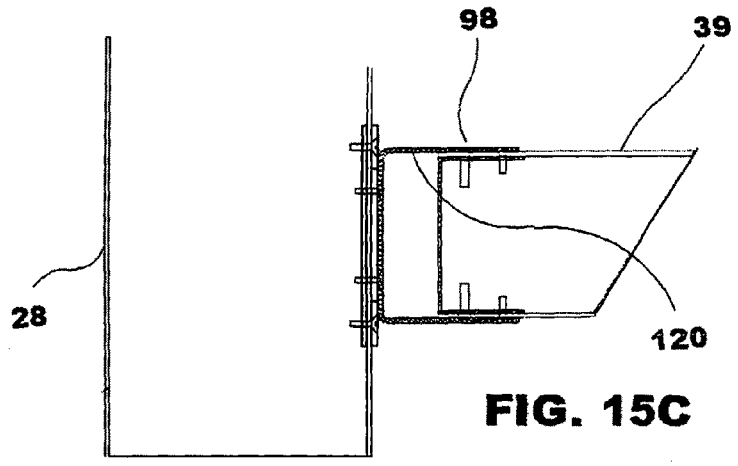
FIG. 15C is a top plan view of with portions removed of the bottom wall element attached to the base element by means of the U-shaped base member.
Figure 15D:
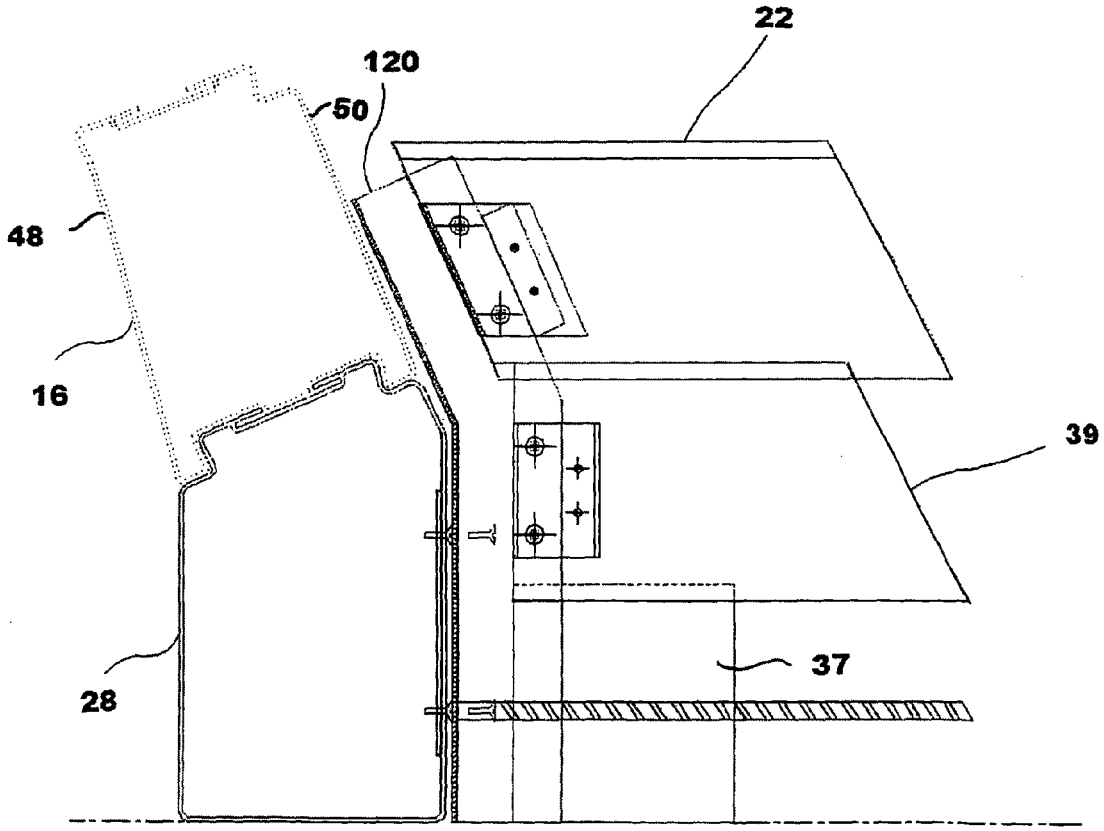
FIG. 15D is a front view similar to FIG. 15C wall element attached to the base element by means of the U-shaped base member.
Figure 15E:
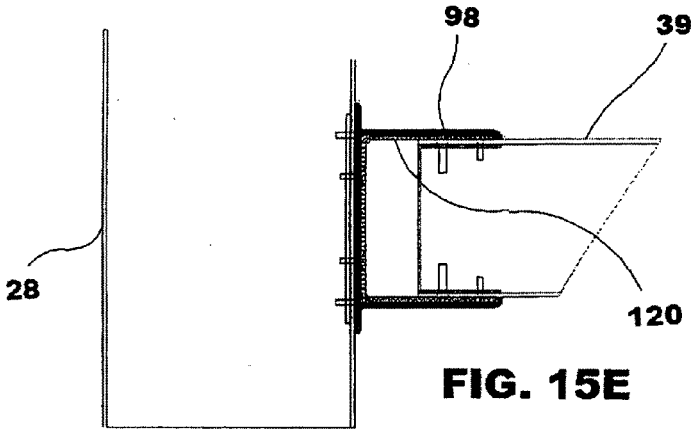
FIG. 15E is a top plan view similar to FIG. 15C except with the installation of the U-shaped curved frame.
Figure 15F:
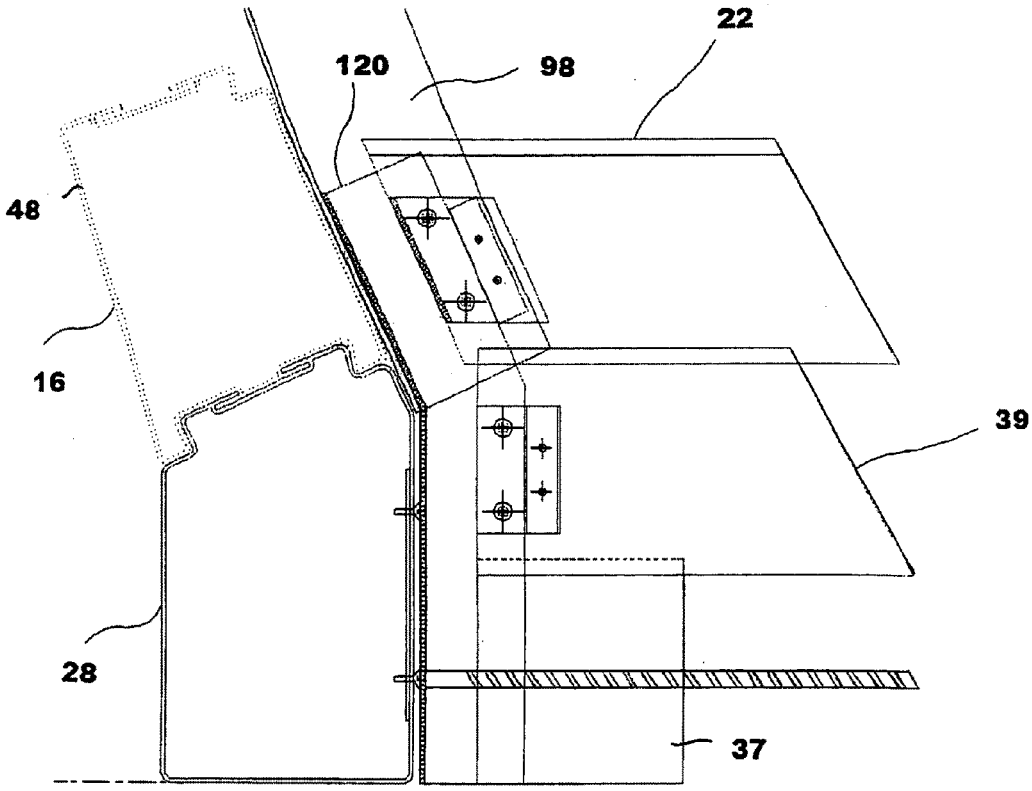
FIG. 15F is a front view similar to FIG. 15E with the addition of the U-shaped curved frame.
Figure 16A:
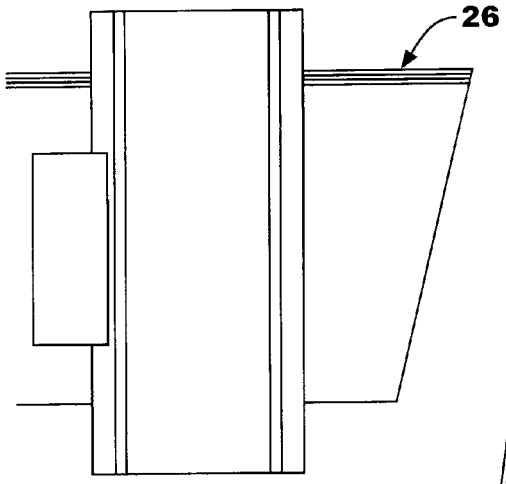
FIG. 16A is a side view with portions removed of the U-shaped curved frame connected to the shell element.
Figure 16B:
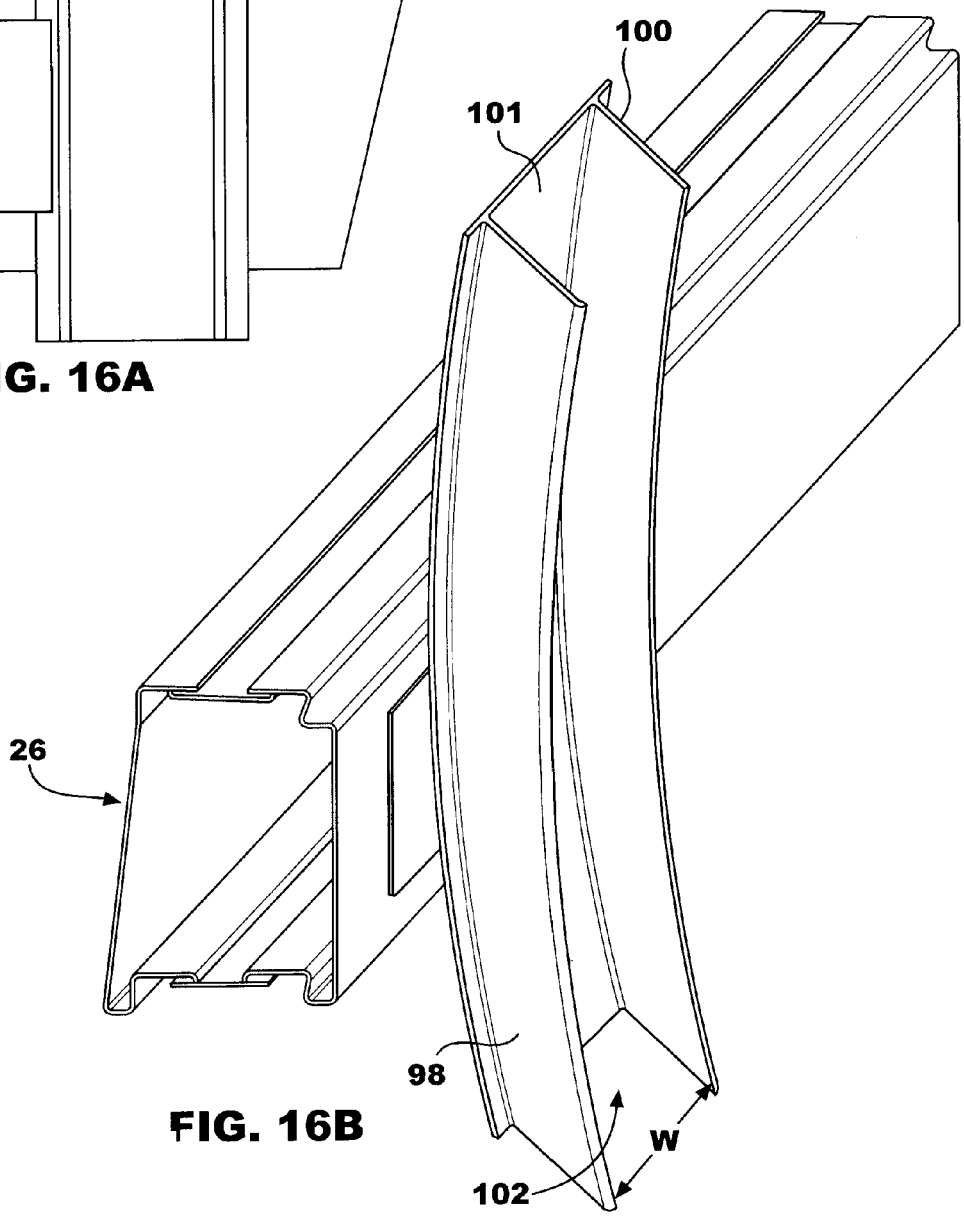
FIG. 16B is a perspective view with portions removed of the U-shaped curved frame mounted to the shell element.
Figure 16C:
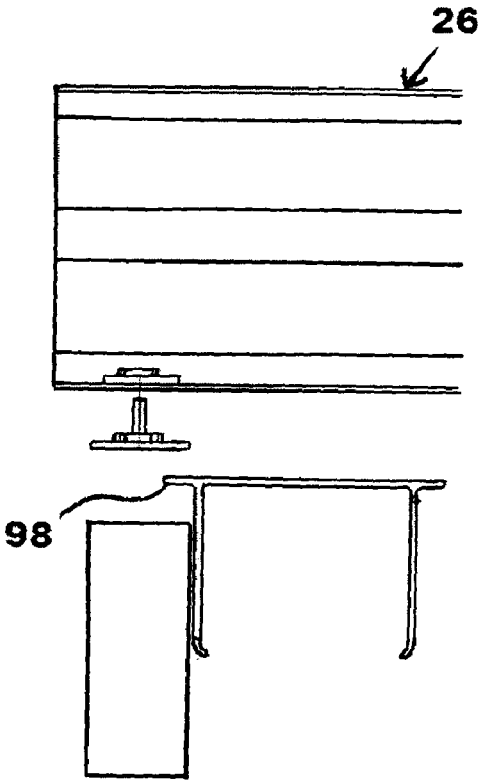
FIG. 16C is an exploded view illustrating how the U-shaped curved frame is connected to the shell element.
Figure 16D:
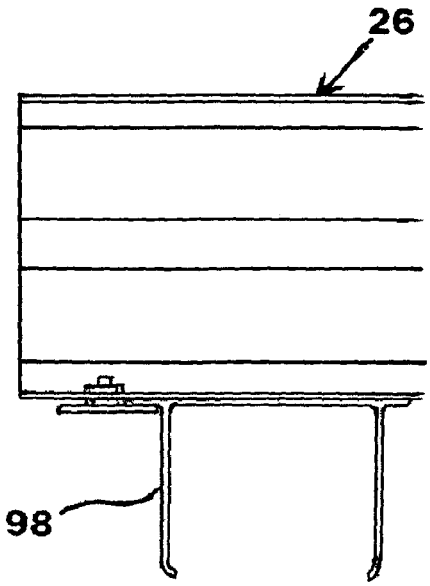
FIG. 16D illustrates the connection of the U-shaped curved frame to the shell element.

FIGS. 15A-15D are similar to FIGS. 14D-14F in that they illustrate the connection of the bottom wall element 95 to the base element 28 by means of the U-shaped base member 120. Once the U-shaped base member 120 is fastened to the base element 28 by means of screws or suitable fasteners 125, the stacked wall elements 94 are received in the frame opening 102 and secured therein. FIGS. 15C and 15D illustrate the addition of the U-shaped curved frame 98 mounted to the U-shaped base member 120.

Figure 17:
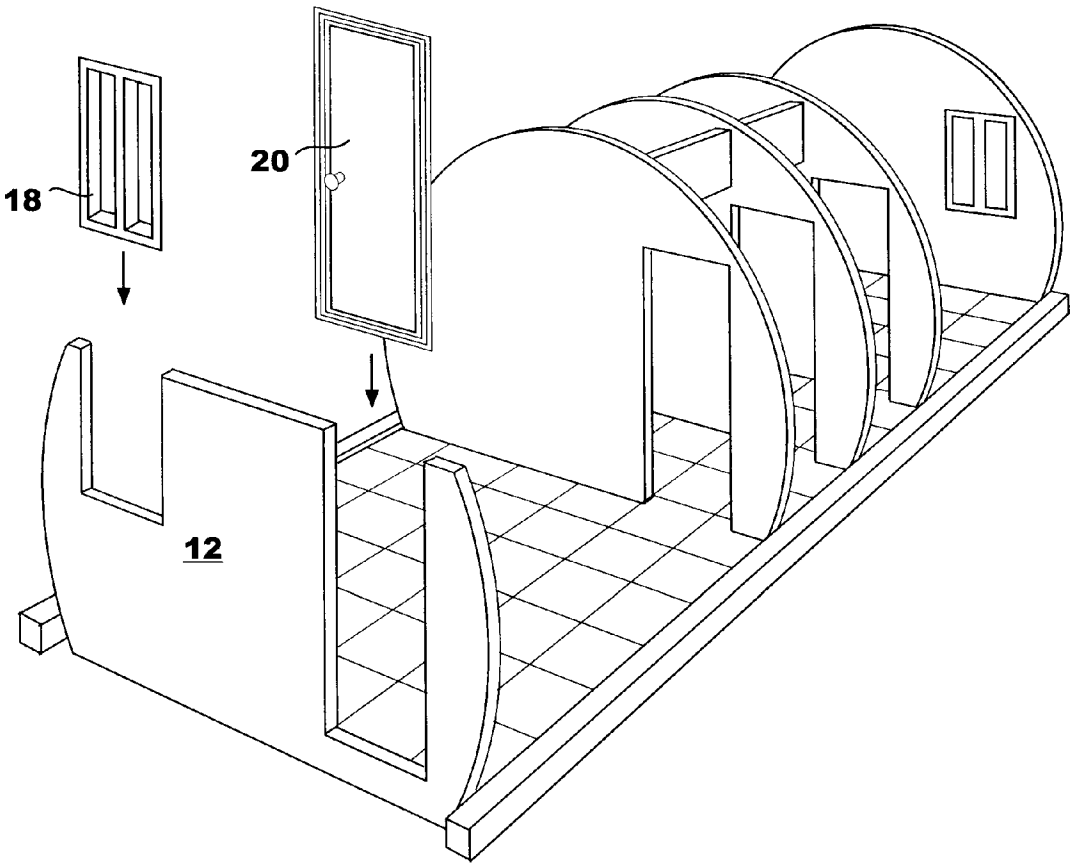
FIG. 17 is a perspective view illustrating the assembly of the front wall before the exterior or shell is constructed.
Figure 18:
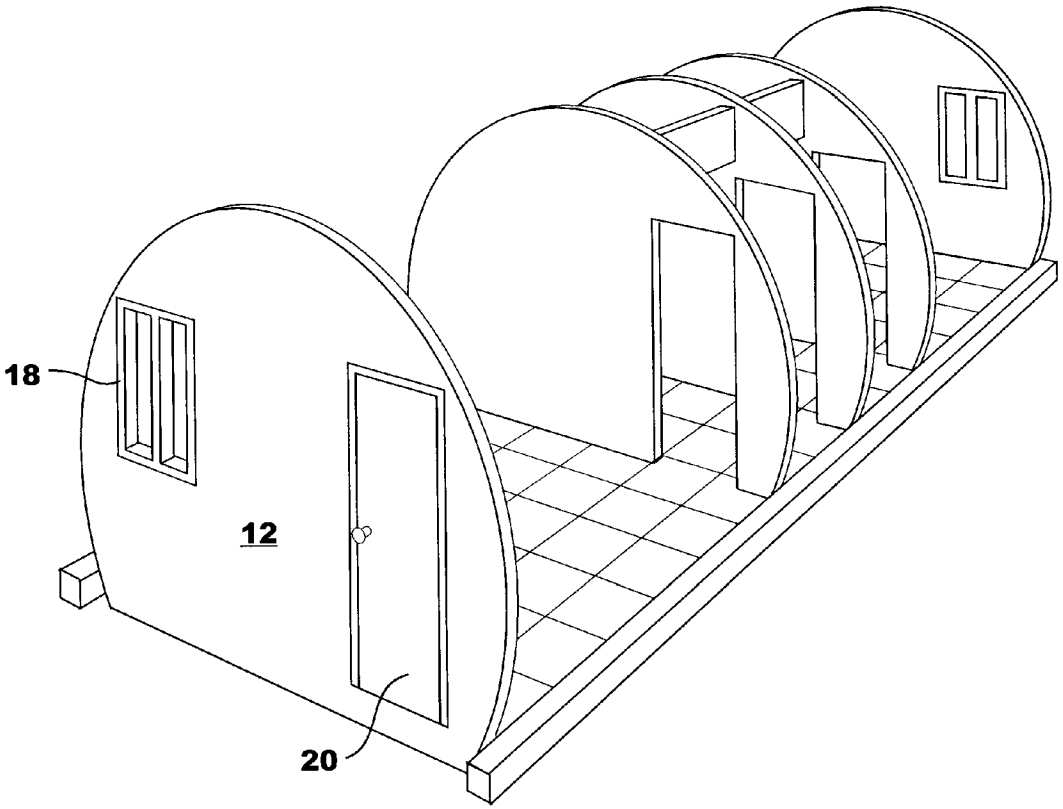
FIG. 18 is a perspective view illustrating the front wall after it is constructed but prior to the erection of the exterior or shell.
Figure 19A:
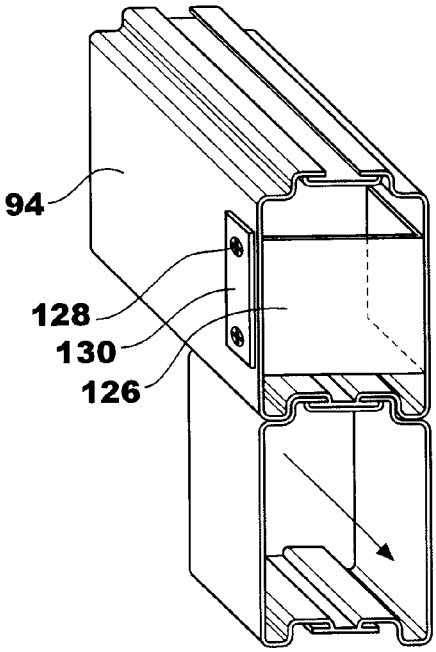
FIG. 19A is a perspective view with portions removed of the interior wall with an end plate attached to it and is used to attach the interior wall to a door or window frame.
Figure 19B:
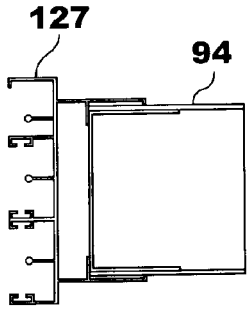
FIG. 19B is a top plan view in cross section of the interior wall of FIG. 19A inserted into the U-shaped window or door frame.
Figure 19C:
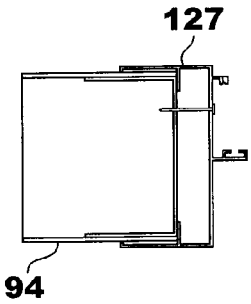
FIG. 19C is a top plan view similar to FIG. 19B of an alternate embodiment of inserting the interior wall into a U-shaped window or door frame.
Figure 19D:
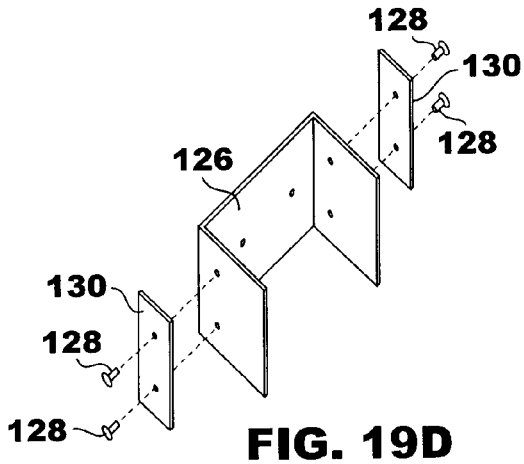
FIG. 19D is an exploded view of the end plate that is mounted into the end of the interior wall.

The initial step in construction of the building 10 is to prepare the concrete pad 35 and place the sub base element 37 in position in the sand and mortar 36. The front 12, rear 14 or interior walls 22 are then erected. As seen, in FIG. 17, various lengths of wall elements 94, which are precut to the appropriate lengths, are slid into place so that they are stacked on top of each other. As seen in FIG. 17, room is left for the door 20 and window 18 to be slid into the front 12. Once both sides of the door 20 and window 18 are completed, the door 20 and window 18 are slid into place. Another wall element 94 representing a lintel or header is slid over the top of the door 20 and window 18. The balance of the wall elements 94 is stacked until the front 12 is completed. The wall elements 94 have a rounded shape to receive the U-shaped curved frame 98 around the perimeter. This same procedure is followed to construct the interior walls 22 and the rear 14. Once this is finished, the exterior wall or shell 16 is erected as previously described.

Mounting a wall element 94 to a door frame or window frame 127 is accomplished in a similar manner as mounting the wall element 94 to the U-shaped curved frame 98. As seen in FIGS. 19A-19D there is an end plate 126 attached with fasteners 128 to the end of the wall element 94. A mounting plate 130 is placed on the outside of the wall element 94 so that the wall element 94 is secured between the mounting plate 130 and the end plate 126. The end plate 126 provides a means to securely connect the wall element 94 to the U-shaped member window or door frame member 127.

The exterior or shell element 26 and the wall element 94 are preferably made of unplasticized polyvinyl chloride (also referred to as "uPVC") or rigid PVC. Other materials can be used, but uPVC has excellent characteristics such as water and weather resistance, it is easily cut to specific lengths, and it is relatively light weight so that two people can position and slide the shell and wall elements into place.

Figure 20A:
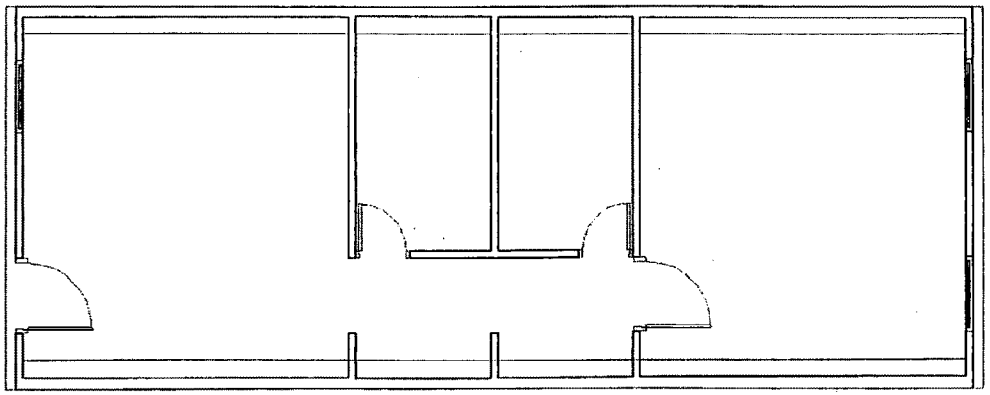
FIG. 20A is a typical floor plan for a two module unit.
Figure 20B:
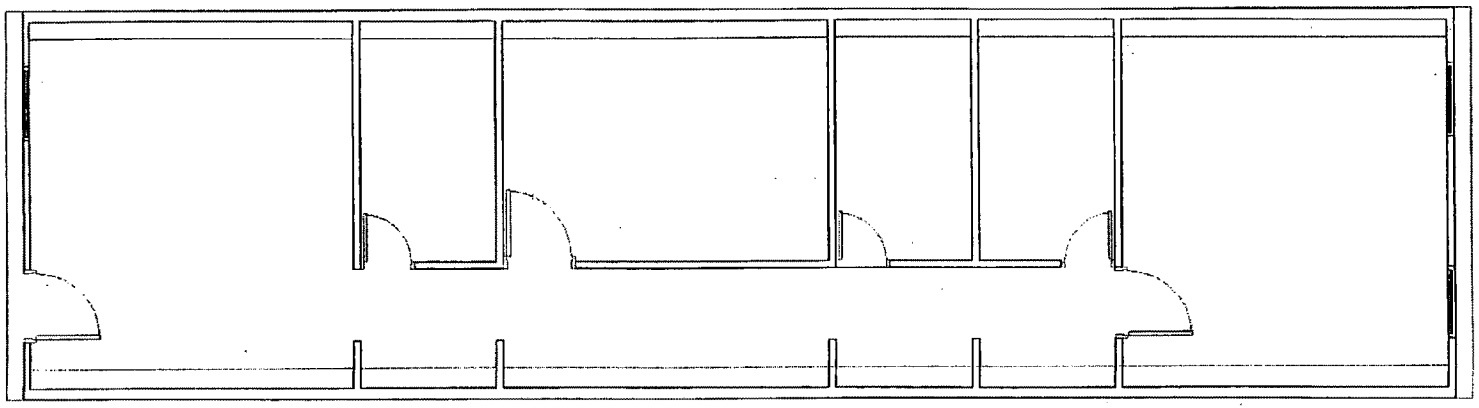
FIG. 20B is a typical floor plan for a three module unit.

Various floor plans are available and by joining modules together lengthwise, the length of the building 10 can be varied. A typical floor plan is illustrated in FIG. 20A which shows how two modules can be joined end to end to form a larger building 10. FIG. 20B illustrates how three modules can be joined to further increase the size of the building.

Figure 21:
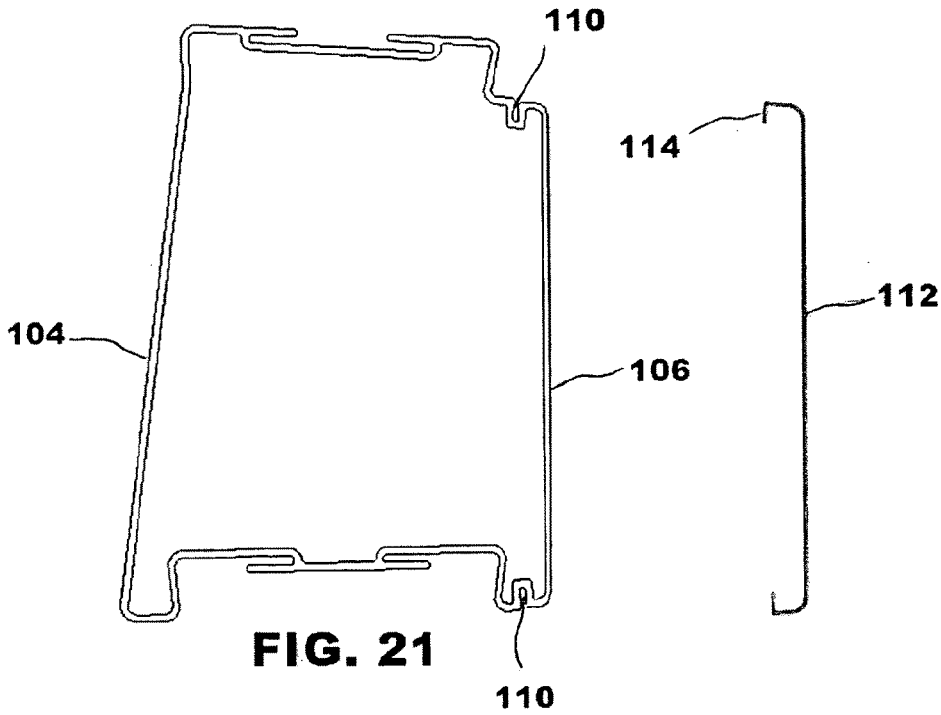
FIG. 21 is a side view of how cladding can be attached to the side of a shell element.
Figure 22:
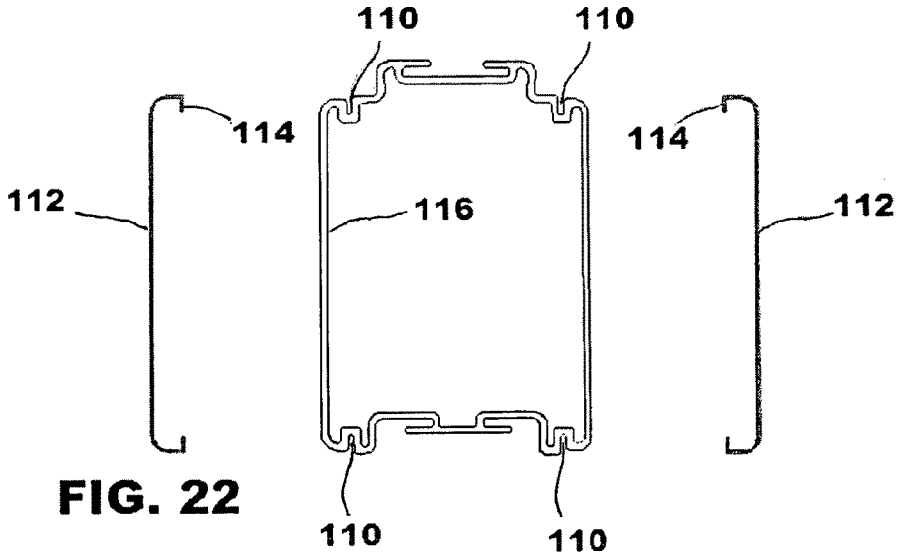
FIG. 22 is a side view of how cladding can be attached to both sides of a wall element.

FIG. 21 illustrates a modified shell element 104 which has a modified exterior wall 106. The exterior wall 106 has a pair of grooves 110 cut into the surface. A cladding sheet 112 has opposite downturned ends 114 that are received in locking engagement in the grooves 110. This holds the cladding 112 onto the exterior wall 106. The interior wall 22 can also be modified to receive cladding such as illustrated in FIG. 22. Here it can be seen that one or both sides of a modified wall element 116 can have grooves 110 added to receive the ends 114 of the cladding 112. The cladding can be made of various materials such as uPVC, PVC, aluminum or other similar materials that will meet the purpose for which it is intended.

Thus there has been provided a modular building system that fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A system for constructing a housing enclosure comprising:

a plurality of elongated shell members having a length and width, and at least four sides in cross section, the elongated shell members having a top, a bottom, and opposite front and back sides, the opposite front and back sides being substantially planar surfaces, the front and back sides each having a height with the height of the front side being greater than the height of the back side, the front side at an acute angle with respect to the bottom, the top and bottom defining confronting surfaces between adjacent elongated shell members, a channel formed on one of the confronting surfaces of the elongated shell members, a tongue formed on the other confronting surface of the elongated shell members, the tongue slidably received in the channel for interlocking one elongated shell member with an adjacent elongated shell member;

the front sides forming a curvilinear exterior wall and the back sides forming a curvilinear interior wall of the housing enclosure when the shell members are stacked one of top of each other and interlocked, a base member disposed at a bottommost elongated shell member on either side of the housing enclosure, each base member having one joining surface to connect to the bottommost elongated shell member, and wherein the front side of an upper shell member has a portion extending over the front side of the shell member immediately below the upper shell member.

2. The system for constructing a housing enclosure of claim 1 and further comprising a joining member slidably received in two adjacent topmost elongated shell members to connect the two topmost shell members.

3. The system for constructing a housing enclosure of claim 1 wherein the elongated shell members have a foot on the bottom and a shoulder on the top, the foot of one elongated shell member engaging the shoulder of an adjacent elongated shell member.

4. The system for constructing a housing enclosure of claim 3 wherein the elongated shell members have a second foot on the bottom and a second shoulder on the top, the second foot of one elongated shell member engaging the second shoulder of an adjacent shell member.

5. The system for constructing a housing enclosure of claim 4 wherein the feet on the one elongated shell member and the shoulders on the adjacent elongated shell member define a circuitous path between the elongated shell members to restrict the flow of water from the front side to the back side of the elongated shell members.

6. The system for constructing a housing enclosure of claim 1 and further comprising a front wall and a rear wall for enclosing front and rear ends of the housing enclosure, the front and rear wall comprised of elongated wall members stacked on top of one another and interlocked to each other.

7. The system for constructing a housing enclosure of claim 6 and further comprising opposite top and bottom surfaces and opposite front and back surfaces on the wall members, the opposite surfaces being substantially parallel to each other, a channel formed on one of the top or bottom surfaces of the elongated wall members, a tongue formed on the other of the top or bottom surfaces of the elongated wall members, the tongue of one wall member slidably received in the channel of an adjacent wall member for interlocking one elongated wall member with the adjacent elongated wall member, the top and bottom surfaces oriented parallel to each other whereby when elongated wall members are stacked one on top another and interlocked they form a substantially vertical wall.

8. The system for constructing a housing enclosure of claim 7 and further comprising a curvilinear member mounted to the shell members to receive the ends of the vertical wall.

9. The system for constructing a housing enclosure of claim 8 wherein the curvilinear member has a U-shaped opening for receiving the elongated wall members of the vertical wall.

10. A housing enclosure comprising:

a substantially curvilinear outer shell comprised of a plurality of elongated shell members, the shell members having a length, a width and a height and a top, a bottom, a front side and a back side, the opposite front and back sides being substantially planar surfaces, the front side and back side each having a height with the height of the front side being greater than the height of the back side, the top and bottom defining confronting surfaces between adjacent elongated shell members, the elongated shell members have a foot on the bottom of one elongated shell member which is received on a shoulder of the top of an adjacent elongated shell member with the foot of one elongated shell member engaging and being supported by the shoulder on the top of the adjacent shell member a channel formed on one of the top or bottom surfaces of the elongated shell members, a tongue formed on the other of the top or bottom surfaces, the tongue slidably received in the channel, and means for interlocking the tongue in the channel for connecting one elongated shell member with an adjacent elongated shell member, the front sides forming a curvilinear exterior wall and the back sides forming a curvilinear interior wall of the housing enclosure when the shell members are stacked one of top of each other and interlocked.

11. The housing enclosure of claim 10 wherein the elongated shell members have a second foot on the bottom and a second shoulder on the top, the second foot of one elongated shell member engaging the second shoulder of an adjacent shell member.

12. The housing enclosure of claim 11 wherein the feet on the one elongated shell member and the shoulder on the adjacent elongated shell member define a circuitous path between the elongated shell members to restrict the flow of water from the front side to the back side of the outer shell.

13. The housing enclosure of claim 10 and further comprising a front wall and a rear wall for enclosing front and rear ends of the housing enclosure, the front and rear wall comprised of elongated wall members stacked on top of one another and interlocked to each other.

14. The housing enclosure of claim 13 and further comprising opposite top and bottom surfaces and opposite front and back surfaces on the wall members, the opposite surfaces being substantially parallel to each other, a channel formed on one of the top or bottom surfaces of the elongated wall members, a tongue formed on the other of the top or bottom surfaces of the elongated wall members, the tongue of one wall member slidably received in the channel of an adjacent wall member for interlocking one elongated wall member with the adjacent elongated wall member, the top and bottom surfaces oriented parallel to each other whereby when elongated wall members are stacked one on top another and interlocked they form a substantially vertical wall.

15. The housing enclosure of claim 14 and further comprising a curvilinear member mounted to the shell members to receive the ends of the vertical wall.

16. The housing enclosure of claim 10 wherein the front side of an upper shell member has a portion extending over the front side of the shell member immediately below the upper shell member.

* * * * *